US009022139B2

(12) United States Patent
Montaron

(10) Patent No.: US 9,022,139 B2
(45) Date of Patent: May 5, 2015

(54) GAS CUTTING BOREHOLE DRILLING APPARATUS

(75) Inventor: Bernard Montaron, Saint Marcel-Paulel (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 859 days.

(21) Appl. No.: 12/742,446

(22) PCT Filed: Nov. 6, 2008

(86) PCT No.: PCT/EP2008/009609

§ 371 (c)(1),
(2), (4) Date: Feb. 3, 2011

(87) PCT Pub. No.: WO2009/062719

PCT Pub. Date: May 22, 2009

(65) Prior Publication Data

US 2011/0120771 A1 May 26, 2011

(30) Foreign Application Priority Data

Nov. 15, 2007 (GB) ..... 0722442.1

(51) Int. Cl.
*E21B 7/14* (2006.01)
*E21B 23/00* (2006.01)

(52) U.S. Cl.
CPC ..... *E21B 7/14* (2013.01); *E21B 2023/008* (2013.01)

(58) Field of Classification Search
CPC ..... E21B 7/06; E21B 7/14; E21B 7/18; E21B 4/18; E21B 2023/008
USPC ..... 175/14
See application file for complete search history.

(56) References Cited

U.S. PATENT DOCUMENTS

| | | | | | |
|---|---|---|---|---|---|
| 3,112,800 | A | * | 12/1963 | Bobo | 175/67 |
| 3,467,206 | A | * | 9/1969 | Acheson et al. | 175/13 |
| 3,620,313 | A | * | 11/1971 | Elmore et al. | 175/14 |
| 3,677,515 | A | | 7/1972 | Fassler | |
| 4,066,137 | A | * | 1/1978 | Frankle et al. | 175/14 |
| 4,099,584 | A | * | 7/1978 | Frankle et al. | 175/14 |
| 4,319,647 | A | * | 3/1982 | Browning | 175/14 |
| 4,519,453 | A | * | 5/1985 | Riddiford | 166/303 |

(Continued)

FOREIGN PATENT DOCUMENTS

| | | |
|---|---|---|
| GB | 768895 | 2/1957 |
| GB | 1179093 | 1/1970 |

(Continued)

OTHER PUBLICATIONS

Search report for the equivalent GB patent application No. 0722442.1 issued on Jan. 15, 2008.

*Primary Examiner* — Jennifer H Gay
(74) *Attorney, Agent, or Firm* — Stephanie Chi; Jody DeStefanis

(57) ABSTRACT

A drilling apparatus for drilling boreholes in an underground formation includes a tool body that can be positioned in a borehole where drilling is to take place. The apparatus further includes a gas cutting torch having a nozzle, a supply of a cutting gas connected to the gas cutting torch. In some embodiments, the gas cutting torch and supply of cutting gas may be connected by an umbilical link. The tool body may be advanced through the borehole as drilling takes place. In some embodiments, the tool body may be advanced via a tractor device that forms part of the tool body or attached to the tool body.

10 Claims, 1 Drawing Sheet

(56) References Cited

U.S. PATENT DOCUMENTS

| | | | | |
|---|---|---|---|---|
| 5,771,984 | A * | 6/1998 | Potter et al. | 175/14 |
| 5,964,303 | A | 10/1999 | Pilchta | |
| 7,584,807 | B2 * | 9/2009 | Berger et al. | 175/14 |
| 7,784,563 | B2 * | 8/2010 | Rodland et al. | 175/16 |
| 7,828,078 | B2 * | 11/2010 | Berger et al. | 175/14 |
| 2003/0121701 | A1 * | 7/2003 | Polizzotti et al. | 175/17 |
| 2005/0150688 | A1 | 7/2005 | MacGregor et al. | |
| 2009/0071713 | A1 * | 3/2009 | Berger et al. | 175/14 |
| 2010/0032207 | A1 * | 2/2010 | Potter et al. | 175/11 |
| 2011/0120771 | A1 * | 5/2011 | Montaron | 175/11 |
| 2011/0174537 | A1 * | 7/2011 | Potter et al. | 175/11 |

FOREIGN PATENT DOCUMENTS

| | | |
|---|---|---|
| GB | 1499378 | 2/1978 |
| WO | 96/03566 | 2/1996 |
| WO | 9603566 | 2/1996 |
| WO | 2004011766 | 2/2004 |
| WO | 2005/054620 | 6/2005 |

* cited by examiner

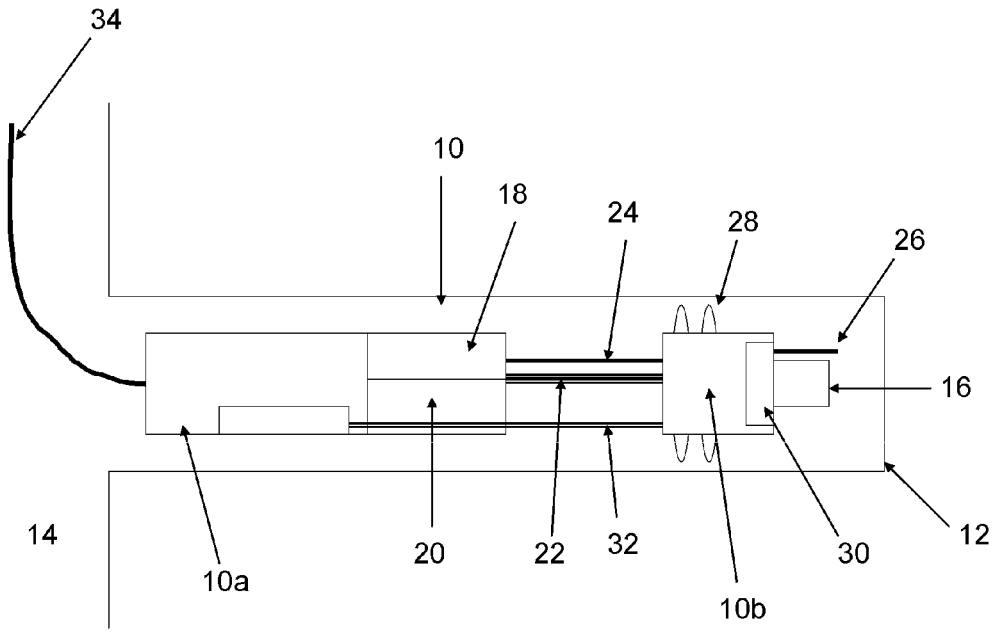
34
10
18
24
28
26
16
14
10a
20
22
32
10b
30
12

GAS CUTTING BOREHOLE DRILLING APPARATUS

CROSS-REFERENCE TO RELATED APPLICATIONS

The present application is based on and claims priority to GB Application No. 0722442.1, filed 15 Nov. 2007; and International Patent Application No. PCT/EP20081009609, filed 6 Nov. 2008. The entire contents of each are herein incorporated by reference.

TECHNICAL FIELD

This invention related to a drilling apparatus based on a gas cutting system for removal of rock. In particular, the invention relates to such a system that is suitable for use in drilling lateral boreholes from a main borehole drilled through underground formations such as is used in the oil and gas industry.

BACKGROUND ART

Conventional hole-making systems used to drill underground boreholes in the oil and gas industry are all based on hydro-mechanical drilling techniques using rotating drill bits and drilling fluid to evacuate rock cuttings. Most of these systems require heavy, bulky and expensive surface equipment—either a complete drilling rig, or a complete coiled tubing drilling system.

New ways of making holes in underground formations have been investigated recently which are not based on mechanical drilling systems. For example, using a laser beam to destroy the rock, or using electrical sparks, or even using high pressure hydraulic jetting with or without solid particles. However, none of these systems have been used for commercial applications such as wells for oil and gas production. A number of technical issues exist with these principles which, as of today, have not been overcome.

This invention is based on the use of a gas cutting system. The terms 'gas cutting', 'gas torch' and other related terminology are used to denote a thermal cutting system in which a jet of hot gas is provided from a torch head for removal of solid material. Common forms of gas cutting technology include oxy-fuel systems in which a fuel and an oxidizing agent are combusted at a burner head to provide a very hot flame (e.g. oxy-acetylene systems); and plasma or plasma arc systems in which a plasma is initiated in a jet of a gas (e.g. argon, nitrogen, oxygen, etc.) by RF stimulation and this is used to remove material.

The aim of the invention is to provide a plasma torch based system that can make long holes in underground formations, in presence of various fluids (oil based mud, water based mud, formation fluids, etc. . . . ), and at temperature and high pressure conditions met at depth exceeding 1000 meters. The system will not only be capable of making holes, but will also eliminate rock particles and will carry its own source of energy for making the hole. The system can be used in particular to make long lateral holes from existing wells.

DISCLOSURE OF INVENTION

A drilling apparatus for drilling boreholes in underground formations, comprising: a tool body that can be positioned in a borehole where drilling is to take place; a gas cutting torch having a nozzle; a supply of a cutting gas connected to the torch; and means for advancing the tool body through the borehole as drilling takes place.

In one embodiment, the gas cutting torch comprises a plasma torch, in which case, the cutting gas is a supply of a single gas or gas mixture to support the plasma. The torch will also have means for generating the plasma in the gas.

In another embodiment, the gas cutting torch comprises an oxy-fuel torch. In this case, the supply of cutting gas will comprise a supply of a fuel and a supply of an oxidizing agent.

In a particularly preferred embodiment, the tool body is formed of two parts, a first part containing the gas supply and the second part containing the torch. The two parts can be separate, in which case they are preferably connected by means of an umbilical carrying the gas and from the first body part to the burner.

The apparatus can also include a direction control mechanism for orienting the nozzle to a desired direction. The nozzle and orienting system can be located in an operating head remote from the tool body, typically connected by means of an umbilical. In this case, the gas supply can be housed in the tool body and provided to the operating head via the umbilical. This can also include an electrical supply line.

The means for advancing the tool body preferably comprises a tractor device that forms part of the tool body or is attached thereto.

The tool body can also include a fluid circulation system for circulating fluid around the nozzle. Where two separate body parts are used, the fluid can be supplied from the first part to the second by means of a hose.

It is particularly preferred that the tool be suspended in the borehole by means of a cable from the surface.

BRIEF DESCRIPTION OF FIGURES IN THE DRAWINGS

FIG. 1 shows an embodiment of the invention.

MODE(S) FOR CARRYING OUT THE INVENTION

FIG. 1 shows one embodiment of the invention based on an oxy-fuel gas cutting system, comprising a tool 10 that is constructed to withstand the high temperature and pressure conditions met in deep oil and gas wells. In the particularly preferred application, the tool 10 is used to construct a lateral well 12 being drilled from a main well 14. The lateral well 12 can typically be of significantly smaller diameter than the main well, for example having a diameter of 1-2 inches and being several hundred meters long.

The tool comprises separate first and second body parts 10*a*, 10*b*, both of which are positioned in the borehole. The second body part 10*b* is provided with a burner having a nozzle 16 for directing the cutting flame. The flame is produced using an oxy-fuel system with two operating fluid supplies. These supply the two fluids required for the oxy-fuel burner or torch to function. Different kinds of chemicals can be used for such a torch, in liquid or compressed gas form: one being an oxidizing agent, typically oxygen: and the other being the fuel, such as acetylene, propylene, methane, hydrogen or the like. The volumes of fluids required for the density of energy necessary for generating holes several hundred of meters long and one to two inches diameter are compatible with the typical size of downhole tools used in the oil and gas industry, including tools than can be run through tubing. Pressurized cylinders 18, 20 are provided in the first body part 10*a* for storing the fuel and oxidizing agent.

A long multi-purpose flexible umbilical 22 links the first and second tool body parts 10*a*, 10*b*. The umbilical 22 combines at least two flexible hydraulic hoses, one for fuel and one for the oxidizing agent, to supply the chemicals to the torch head 16, and an electrical multi-wire flexible cable 24 used to bring electrical power for a torch ignition system 26 and for measurements and control of the torch head. Additional systems can also be attached to the first body part 10*b* such as a tractor device 28 and a directional control system 30.

A mud circulation system is also required in the lateral 12 in order to facilitate the renewal of fresh mud, in order to dissolve residual molecules generated by the destruction of the rock by the torch, and also to cool down the torch head and the systems attached to it. This may be realized by providing a pumping system in the first body part 10*a* which is connected to the second body part by means of a third hydraulic hose 32 inside the umbilical 22.

The entire system can be deployed into the well on an electrical wireline 34 in order to facilitate the real-time placement and control of the downhole operation from surface.

There are a number of advantages of such a system over other known systems.

This system allows for holes to be made that start at any angle, including right angles, from an existing well.

The torch will melt the rocks and will break the chemical species present in the rocks into two phases: molecules which will dissolve in the mud (particularly if it is water based mud); and molecules that will generate a zero porosity vitrified residual layer on the wall of the hole. The resulting section of the hole will come from the volume reduction due to the removal of the porosity from (typically) 30% in the original rock to 0% in the vitrified material, and from the dissolution of the soluble molecules and the hydrolysis of rock. This means that no specific cuttings handling system is required when using a torch based system. In addition the vitrification of the borehole can also be seen as a big advantage since it constitutes an automatic casing system for the lateral hole.

The torch system does not require application of a force ("weight") at its end in order to be effective. The system carries its own energy. This is a tremendous advantage for making long lateral holes. Also, because of this, the system is fairly easy to direct in 3D space in order to control the direction of the lateral hole using an appropriate 3D control system located next to the torch head.

The system should work equally well in a barefoot well, or a cased and cemented well. There is no need for a specific system to drill through the casing and cement. The torch will melt the steel casing and the metal will flow downwards in a vertical direction and solidify in place.

The embodiment described above will be different in certain aspects for a plasma gas cutting system. Instead of two gas supplies 18, 20 only one is normally needed. Also, the ignition system 26 must be replaced with a plasma starter and means for sustaining the plasma with appropriate electric power and control systems.

A number of other advantages exist for such a system within the scope of this invention.

What is claimed is:

1. A drilling apparatus for drilling boreholes in underground formations, comprising:

a tool body configured to be positioned in a borehole where drilling is to take place, wherein the tool body comprises:

a first tool part comprising a plurality of pressurized chambers configured to store a fuel and an oxidizing agent;

a second tool part separate from the first tool part, wherein the second tool part comprises a gas cutting torch having a nozzle; and an umbilical link coupling the first tool part to the second tool part, wherein the umbilical link comprises a first flexible hydraulic hose, a second flexible hydraulic hose, and a third flexible hydraulic hose, wherein the first flexible hydraulic hose is configured to transport the fuel to the second tool part, and wherein the second flexible hydraulic hose is configured to transport the oxidizing agent to the second tool part, and wherein the third flexible hydraulic hose is configured to transport mud between the first tool part and the second tool part.

2. The apparatus as claimed in claim 1, wherein the gas cutting torch comprises a plasma torch; the cutting gas comprises a supply of a single gas or gas mixture to support the plasma; and the drilling apparatus is configured to generate the plasma in the gas.

3. The apparatus as claimed in claim 1, wherein the gas cutting torch comprises an oxy-fuel torch; and the supply of cutting gas comprises a supply of a fuel and a supply of an oxidizing agent.

4. The apparatus as claimed in claim 1, wherein the tool body is suspended in the borehole by means of a cable from the surface.

5. The apparatus as claimed in claim 1, wherein tool body includes a fluid circulation system for circulating drilling fluid around the nozzle.

6. The apparatus as claimed in claim 1, wherein the gas cutting torch includes a direction control mechanism for orienting the nozzle to a desired direction.

7. The apparatus as claimed in claim 1, further comprising a tractor device that forms part of the tool body, wherein the tool body is advanced in the borehole as drilling takes place using the tractor device.

8. The apparatus as claimed in claim 1, wherein the umbilical link comprises a cable for supplying power to the second tool part.

9. The apparatus as claimed in claim 1, further comprising a connector configured to connect with a tractor, such that the tool body is advanced in the borehole as drilling takes place when the connector is engaged by the tractor.

10. The apparatus as claimed in claim 1, further comprising a cable configured to transmit electrical power to the gas cutting torch.

* * * * *